US008376912B1

(12) United States Patent
Dedvukaj

(10) Patent No.: US 8,376,912 B1
(45) Date of Patent: Feb. 19, 2013

(54) FACIAL MUSCLE EXERCISE BALL-LIKE DEVICE AND METHOD

(75) Inventor: Robert Dedvukaj, Yonkers, NY (US)

(73) Assignee: Ball It, Inc., Yonkers, NY (US)

( * ) Notice: Subject to any disclaimer, the term of this patent is extended or adjusted under 35 U.S.C. 154(b) by 196 days.

(21) Appl. No.: 13/019,855

(22) Filed: Feb. 2, 2011

Related U.S. Application Data

(60) Provisional application No. 61/301,175, filed on Feb. 3, 2010.

(51) Int. Cl.
*A63B 21/00* (2006.01)

(52) U.S. Cl. ..... 482/11; 482/49; 482/148

(58) Field of Classification Search ..... 482/49, 482/11, 121; 426/104, 132
See application file for complete search history.

(56) References Cited

U.S. PATENT DOCUMENTS

| | | | | |
|---|---|---|---|---|
| 3,525,520 | A * | 8/1970 | Dwyer | 482/11 |
| 4,195,833 | A | 4/1980 | Svendsen | |
| D282,949 | S | 3/1986 | Arve | |
| 4,650,182 | A | 3/1987 | Ross | |
| 4,666,148 | A | 5/1987 | Crawford | |
| 4,823,778 | A | 4/1989 | Ewing | |
| 5,005,826 | A | 4/1991 | Merrick | |
| 5,213,553 | A * | 5/1993 | Light | 482/11 |
| 5,242,347 | A | 9/1993 | Keeton | |
| 5,302,165 | A | 4/1994 | Caruthers | |
| 5,501,646 | A | 3/1996 | Miller | |
| D370,243 | S | 5/1996 | Thompson | |
| D370,951 | S | 6/1996 | Lazar | |
| 5,556,357 | A | 9/1996 | Hanna | |
| D388,846 | S | 1/1998 | Burghoffer | |
| D397,173 | S | 8/1998 | Edell | |
| D403,381 | S | 12/1998 | Hanna | |
| 5,919,116 | A | 7/1999 | Edell | |
| 5,971,890 | A | 10/1999 | Tyne | |
| D425,583 | S | 5/2000 | Tyne | |
| 6,171,214 | B1 | 1/2001 | Lundin | |
| 6,179,747 | B1 | 1/2001 | Kelley | |
| 6,203,470 | B1 | 3/2001 | Lundin et al. | |
| D455,182 | S | 4/2002 | Chu | |
| D456,051 | S | 4/2002 | Mitchell | |
| 6,406,404 | B1 | 6/2002 | Chu | |
| 6,406,405 | B1 | 6/2002 | Chu | |
| D464,095 | S | 10/2002 | Yu | |
| 6,524,225 | B1 | 2/2003 | Arias | |
| 6,547,703 | B1 | 4/2003 | Swezey | |
| D478,947 | S | 8/2003 | Lu | |
| 6,652,275 | B2 | 11/2003 | Byers | |
| D486,192 | S | 2/2004 | Pointer, Jr. | |
| D494,233 | S | 8/2004 | Kerry | |
| D498,799 | S | 11/2004 | Kerry | |
| D503,756 | S | 4/2005 | Chiang | |
| D521,084 | S | 5/2006 | Huang | |
| 7,101,314 | B1 | 9/2006 | Wang | |
| 7,153,237 | B2 * | 12/2006 | Norton | 482/11 |
| 7,214,205 | B2 | 5/2007 | Sils | |
| D552,696 | S | 10/2007 | Hallar | |
| 7,306,550 | B2 | 12/2007 | Lin | |
| 7,384,377 | B2 | 6/2008 | Berman | |
| 7,462,132 | B2 | 12/2008 | Kuehne | |
| 7,476,180 | B1 | 1/2009 | Cobb | |
| 7,500,279 | B2 | 3/2009 | Jackson | |
| D622,333 | S | 8/2010 | Eckermann | |
| D628,662 | S | 12/2010 | Heller | |
| 8,105,210 | B2 * | 1/2012 | Seybold | 482/11 |
| 2003/0023313 | A1 | 1/2003 | Byers | |
| 2007/0225137 | A1 | 9/2007 | Mednick | |
| 2009/0029833 | A1 | 1/2009 | Lin | |

* cited by examiner

*Primary Examiner* — Jerome W Donnelly
(74) *Attorney, Agent, or Firm* — Wilson IP Law; M. Lisa Wilson

(57) ABSTRACT

The present invention relates to a ball-like exercise device adapted for insertion in the mouth and to be used for exercising, strengthening and/or toning facial and/or jaw muscles.

17 Claims, 6 Drawing Sheets

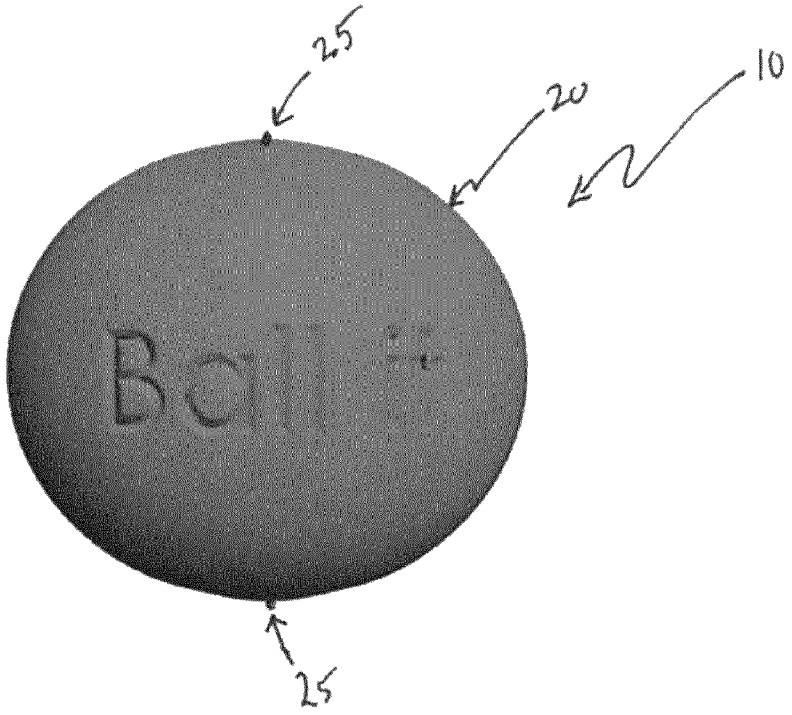
Figure 2. Front
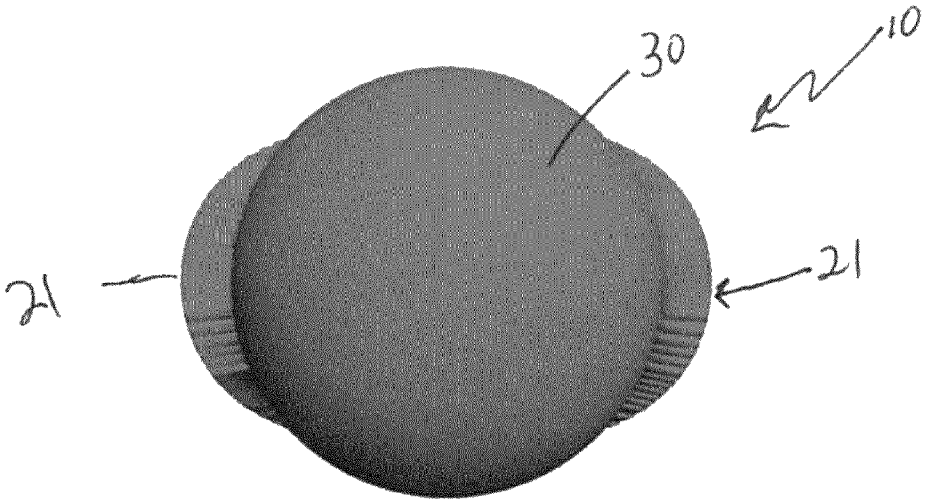
Figure 3. Back

FACIAL MUSCLE EXERCISE BALL-LIKE DEVICE AND METHOD

FIELD OF THE INVENTION

The present invention relates to a ball-like exercise device adapted for insertion in the mouth and to be used for exercising, strengthening and/or toning facial and/or jaw muscles.

BACKGROUND OF THE INVENTION

A variety of exercise devices for facial, neck and jaw muscles are known in the art, each with different advantages and disadvantages. Devices designed to be worn on the head or the body tend to be overly cumbersome or complicated relative to the limited muscular area of interest. For example, U.S. Pat. No. 4,195,833 describes a method to tone facial muscles using a weighted headband by positioning the body with shoulders nearly parallel to the floor and executing a series head and neck movements while contracting certain facial muscles. U.S. Pat. No. 4,650,182 relates to a jaw exercise device using a headband and chin strap interconnected with vertical elastic straps and used by repetitively opening and closing the lower jaw.

U.S. Pat. No. 5,242,347 provides a sit-down weight machine with a pulley system of weights connected via a headband to the user. The user sits on the bench and performs various exercises that isolate use of the face and neck muscles in conjunction with the weights.

In U.S. Pat. No. 5,501,646, a harness-like apparatus worn from shoulders to waist supports a spring-loaded piston with a chin rest on the end. The wearer places his chin on the chin rest, grasps the piston handle and moves the piston up and down to exercise the jaw and neck muscles. In U.S. Pat. No. 6,179,747, a facial muscle exercise device with interconnected headband, neck band, chin cup and side bands is used to provide variable resistance to the muscles upon moving the mouth, eyebrows, neck and chin against that resistance. Such actions lead to toning of various facial muscles.

Exercise devices that include masks, tapes and membranes have also been described. For example, U.S. Pat. No. 4,666,148 provides an exercise mask and U.S. Pat. No. 4,823,778 relates to use of a stiffening tape and weights to improve tone of the facial muscles. U.S. Pat. No. 7,384,377 describes a method of reducing facial wrinkles using a flexible membrane mask with a hand-manipulated rotary device. In another variation, U.S. Pat. No. 7,101,314 provides a set of generally flat facial exercise weights (of varying shape and weight) that are placed on the surface of the face while exercising the facial muscles.

While these exercise devices may improve facial muscle tone and strength, the devices are complicated, bulky or cumbersome, leaving the art with a need for simple and convenient devices or methods to improve facial muscle tone and appearance.

Other known exercise devices fit in the mouth during use. For example, U.S. Pat. No. 5,556,357 relates to an exercise band that spans the width of the mouth and has nibs that are inserted into the mouth and gripped between the upper and lower teeth. The device also has an elastic tension cord mounted at each end of the mouth-spanning band, and when the cord is placed behind the teeth and the lips are moved between forming an "O" and a smile, the muscles in the face, chin and neck are exercised.

Another device that is placed in the mouth for use is described in U.S. Pat. No. 5,919,116. This complicated device is composed of two identical shafts that slide relative to each other through a central hub with a spring or other means to exert resistance between the shafts. The device is placed in the front of the mouth and exerts outward pressure at the corners of the mouth as the shafts slide relative to each other during exercise.

U.S. Pat. No. 6,406,404 relates to a device that is similar in operation to that described in the '116 patent. The '404 device has telescoping shafts that exert outward pressure or resistance at the corners of the mouth. The device described in U.S. Pat. No. 6,406,405 is a further variation on the construct of the '404 patent, with the lip-engaging pieces being flared and weighted.

U.S. Pat. No. 6,524,225 provides a kit of three instruments for inserting into the mouth and exercising jaw, jowl and neck muscles. One device is a flat rod with different-sized flat rings at the ends. A second device is a hollow, bulb-like instrument with a small bulb connected to and a larger bulb. The smaller bulb is grasped between the teeth and used by blowing air out surface holes on the larger bulb which remains outside of the mouth. The third device of the set has a flat, notched piece with a double-bend handle for grasping. The user grips the handle, inserts the flat piece into the mouth (like a tongue depressor) and performs exercises for the facial muscles.

U.S. Pat. No. 7,462,132 provides a Y-shaped facial muscle exercise device with the ends of each arm having upper and lower pads adapted to receive rear molars. The distance between each arm is incrementally adjustable to account for variation in jaw sizes. In some variations, the other end has a second Y-shaped assembly adapted to receive the pre-molar teeth of the user. Both devices are used by placing in the mouth, adjusting the assembly for comfort and repeatedly biting down on the apparatus.

U.S. Pat. No. 7,476,180 relates to a facial muscle exercise device having a spring-loaded hinge connecting a pair of u-shaped plates with channels sized to engage the user's upper and lower sets of teeth.

The above-described devices that fit in the mouth have moving parts, must be specifically adapted to fit each individual, lack safety elements or are complicated to use, and therefore present several disadvantages to the user. Hence, there remains a need for simple devices that are portable and can be used by any individual without alteration. The present invention satisfies these needs by providing a simple, ball-like device for exercising the face and jaw muscles.

While exercise fitness balls are known in the art, such balls are generally large (diameter greater than 8 inches) and designed for working arm, leg and core body muscles. See, for example, U.S. Pat. Nos. 6,547,703 and 7,306,550 as well as U.S. Patent Appln. Pub. No. 2007/0225137. A medium-sized exercise ball (diameter of 3-8 inches) is described in U.S. Pat. No. 5,005,826. The ball of the '826 patent is an isokinetic resistance ball for exercising neck muscles. The device is a hollow, variable pressure ball that is placed between the forehead and a fixed, vertical surface and used by rotating the head in all directions. U.S. Pat. No. 5,971,890 relates to resilient, medium-sized foam ball with a cut-out contoured to fit under a person's chin and sized so that bottom of the ball rests on the person's chest. When so positioned, chin and neck muscles are exercised by lowering and raising the chin again the device. In U.S. Pat. No. 6,203,470, a vibrator has been added to the foam ball-like device of the '890 patent. Finally, U.S. Pat. No. 7,214,205 provides a small exercise gel ball (diameter less than 3 inches) for relieving muscle pain, especially back pain, by using the ball to massage pressure points on one's back. None of these balls are of a suitable design, purpose or size for use in the mouth to exercise facial and jaw muscles.

SUMMARY OF THE INVENTION

The present invention is directed to a ball-like exercise device of a size adapted to fit in a user's mouth. The device comprises a spherical element conjoined to an ellipsoid safety element that extends sideways around the smaller spherical element. The top and bottom of the spherical element have symmetrically opposed, shallow indentations shaped to guide placement of a user's upper and lower teeth. Devices of the invention are made of a biocompatible, resilient material, typically rubber, silicone or latex, and can be optionally made from or coated with a food grade-rubber or food-grade silicone to provide biocompatibility. The devices of the invention have a resistance between about 40 to about 150 pounds per square inch (psi). In preferred embodiments, the resistance of the device is between about 60 psi to about 120 psi. Preferred devices have a resistance of 60, 90 or 120 psi.

In a some embodiments, the ball-like exercise devices of the invention have a grip means on the ellipsoid safety element as well as a nib for attaching a cord, string, elastic string, lanyard and the like. These attaching means can form necklaces, bracelets or have a wristband attached.

Another aspect of the invention provides an exercise kit comprising from two to six ball-like exercise devices of the invention, with each device in the kit having the same or a different resistance. The devices can be conveniently color-coded to simplify user selection and to distinguish devices of different psi. A preferred kit can be compartmentalized to contain three exercise devices of the invention, with a first device having a resistance of 60 psi, a second exercise device having a resistance of 90 psi and a third device having a resistance of 120 psi. The kits of the invention can optionally contain one or more sets of instructions detailing how to use the device to exercise, tone and/or strengthen exercise facial muscles and may also include a a weight loss plan.

In a further aspect, the instant invention is directed to a method of exercising, toning and/or strengthening facial muscles. In accordance with methods of the invention, the user places or positions one of the ball-like devices of the invention in the mouth by gripping the device between the upper and lower teeth using the guide indentations. Once the device is in position, the user exercises the facial muscles and/or jaw muscles by moving the jaw and/or cheeks in a series of movements, including but not limited to, chewing, gnawing, grimacing, smiling, mouth-opening or mouth-closing motions while grasping the device between the teeth. With regular use of the device, the user's facial and jaw muscles are toned and/or strengthened, providing for a better facial appearance and a generally more youthful appearance. Additionally, regular use appears to lead to weight loss. When the exercises are performed in conjunction with following or maintaining a healthy diet, the weight loss can be significant. Regular exercise, for example, includes exercising with the device by performing from 1 to 4 sets of exercises from three to seven days per week. Each set includes from about 5 to about 30 repetitions of one or more movements of the jaw and/or cheeks, e.g., repeating the chewing, gnawing, grimacing, smiling, mouth-opening or mouth-closing motions, in any combination in each set. In a preferred embodiment, the user begins a exercise program with a 40-60 psi device of the invention and progresses to exercising with higher psi devices as the facial and jaw muscle are strengthened.

BRIEF DESCRIPTION OF THE DRAWINGS

FIGS. 2-4 show different views of the same embodiment.

FIG. 2 is a front view of an exercise ball of the invention.

FIG. 3 is a back view of an exercise ball of the invention.

FIG. 4 shows views of the exercise ball from (A) the right side, (B) the front right perspective and (C) the bottom right perspective.

DETAILED DESCRIPTION OF THE INVENTION

The present invention is directed to a ball-like exercise device (also referred to herein as an exercise ball) for exercising the facial and jaw muscles. A portion of the device fits into a user's mouth in such a manner to permit it to be used with a chewing motion or other facial motions or movements. Such actions lead to toning and/or strengthening of the facial muscles as well as to enhancing facial appearance. In addition, use of an exercise ball of the invention may lead to other positive body effects, including weight loss, teeth strengthening, stress relief and, in the relevant population, inhibition or cessation of smoking. Regular use of the instant exercise device, optionally in conjunction with a healthy diet, may lead to weight loss or to at least maintenance of a steady weight.

Figure 1:
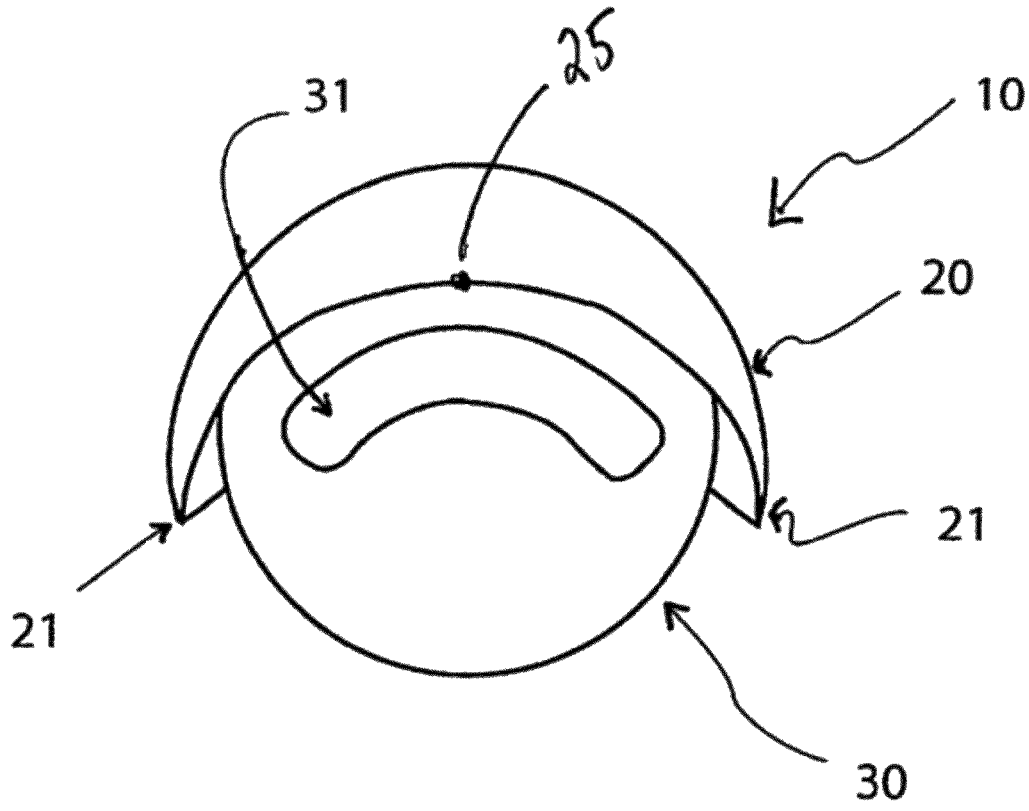
FIG. 1 is a top view of an exercise ball of the invention.

One embodiment of the invention is shown in FIGS. 1-4. FIGS. 1 and 2 provide top and bottom views, respectively, of the ball-like exercise device 10 and show the symmetrical nature of the device. This ball-like exercise device 10 consists of two parts: the main body 30, which is spherical in shape, and the safety element 20 which has an ellipsoid shape (somewhat like a rugby ball) relative to the main body 20. These two parts of the device are smoothly conjoined or united at points 25 on the top and bottom of the device whereas the two parts overlap at the sides to form the safety ears 21. The safety element 20 as a whole, and the safety ears 21 in particular, extend sideways around the main body 20 to at least the mid-point of the main body as illustrated in FIG. 1.

The points 25 at which the two parts of the device join are generally co-planar on a vertical plane that that passes through the main body 30 at a point ranging from about ¼ d to about ⅝ d (moving from front to back when viewing the device from the side), where d would be the diameter of the main body 30 if the device were perfectly spherical. Further, if the two parts are conjoined at a plane that passes through ½ d (i.e., through the center of the sphere), then the distance between the two points 25 is d, and this value of d defines the shorter diameter of the prolate ellipsoid shape forming the elliptical safety element 20. The longer diameter of the ellipsoid shape forming the elliptical safety element 20 is defined by the distance between the outer edge of the safety ears 21 and is always greater than the diameter of the theoretical sphere formed by the main body 30.

If the main body 30 were perfectly spherical, the actual diameter of the sphere is adapted to fit in the mouth of the user in a manner so that it can be comfortably grasped between the upper and lower teeth. In preferred embodiments, the actual diameter of this theoretical sphere is between about 1⅝ inches to about 2⅝ inches, and more preferably between about 1¾ inches to about 2³⁄₁₆ inches. The safety element 20 is proportioned accordingly to conjoin the two elements at top and bottom and to provide a side overlap, which typically means that the safety ears 21 protrude out approximately ¼ to ½ inch on each side of the main body 30.

The devices of the invention are generally symmetrical when viewed from top or bottom. FIG. 1 shows that the top and bottom portions of the main body 30 have symmetrically opposed indentations 31 which are shaped to guide placement of a user's upper and lower teeth and thereby proper alignment of the device 10 in the mouth.

The indentations can be are curved or angular so long as they approximate the shape of the teeth in the jaw bone. A broad u-shaped is one example for the shape of the indentation. The indentations can have a variable depth, for example, from about 1 mm to about 10 mm, and preferably about 1 to about 2 mm. Hence, the indentations are relatively shallow and can form a shallow groove or channel adapted to accommodate at least some, but not necessarily all, of the user's teeth. The shallow indentations (of approximately 1-3 mm) serve as a guide markers for the placement of the user's front teeth or, if the arms of the "u" are extended further, for some or all of the molars. Deeper indentations, if used, can be adapted to conform to the shape and length of the most of the teeth. If used, deeper indentations need to have a width sufficient to accommodate the widest teeth (e.g., the molars). Shallow indentations are preferred. Further, while it is preferred that the indentations be symmetrical and identical in shape, they can be varied to help the user distinguish between and identify the top and bottom of the device.

Figure 4A:
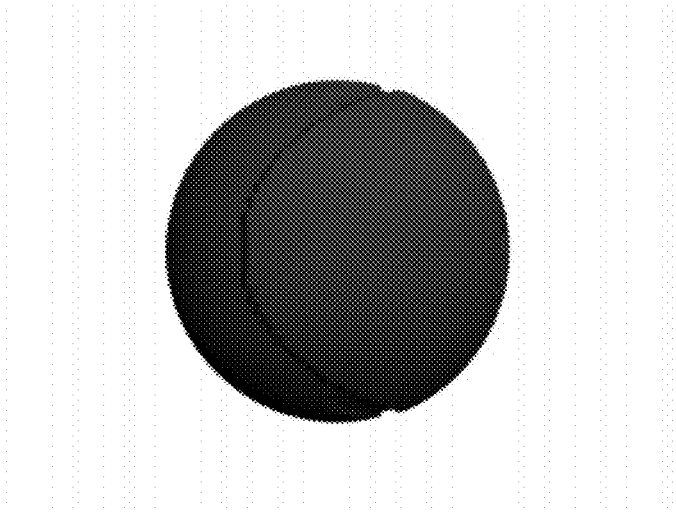
Figure 4B:
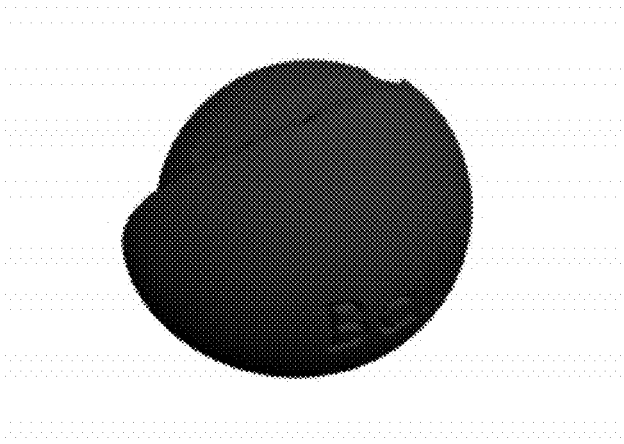
Figure 4C:
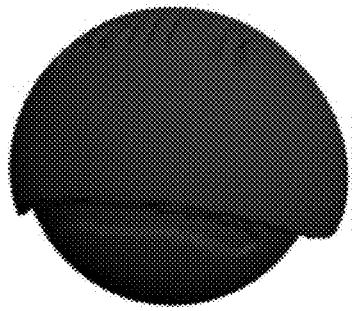
Figure 5:
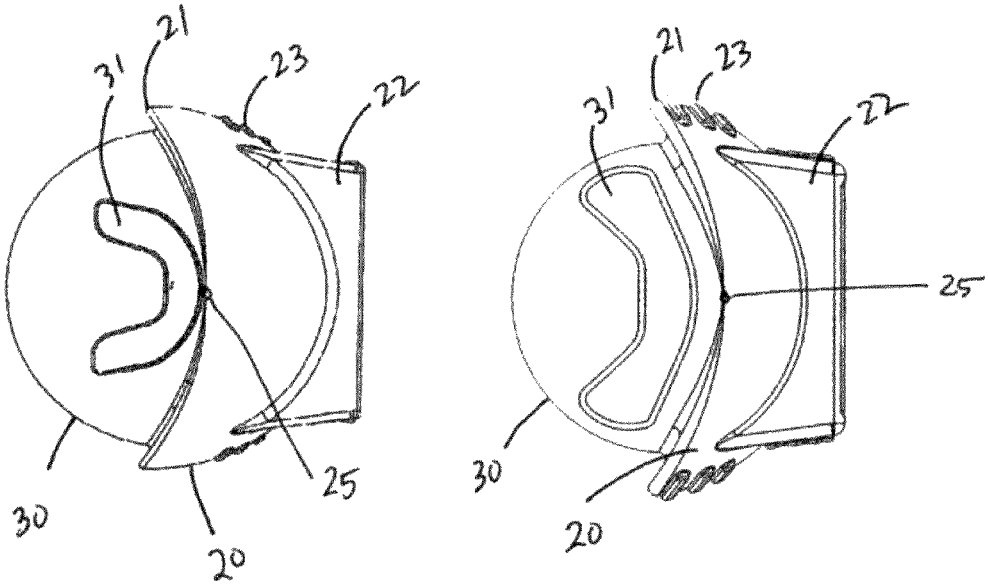
FIG. 5 provides top views of two additional exercise balls of the invention, showing alternative indentations and configurations for the exercise balls.

FIGS. 2 and 3 depict front and back views of the embodiment of the invention shown in FIG. 1. The front view shows that the safety element 20 completely overlaps or envelopes the main body 30 and illustrates the ellipsoid nature of the device when viewed from the front. The back view shows the safety ears 21 extending beyond the main body 30. The safety ears 21 in this embodiment are shown with optional ridges on the underside. FIG. 4 shows a right side view as well as right side perspective views.

Figure 6:
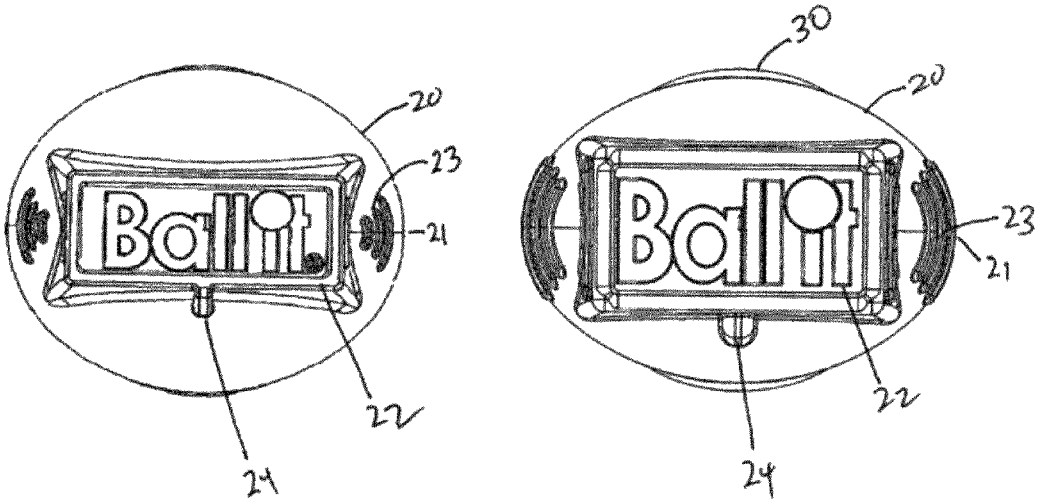
FIG. 6 provides front views of the balls depicted in FIG. 5.
Figure 7:
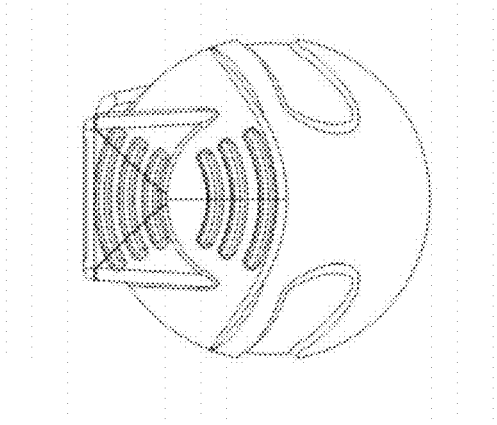
FIG. 7 is a side view of an exercise ball of the invention.
Figure 8:
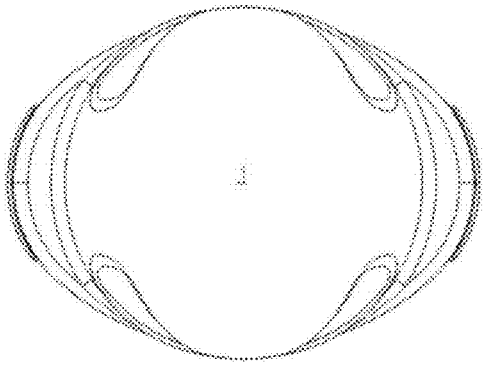
FIG. 8 is a back view of an exercise ball of the invention.
Figure 9:
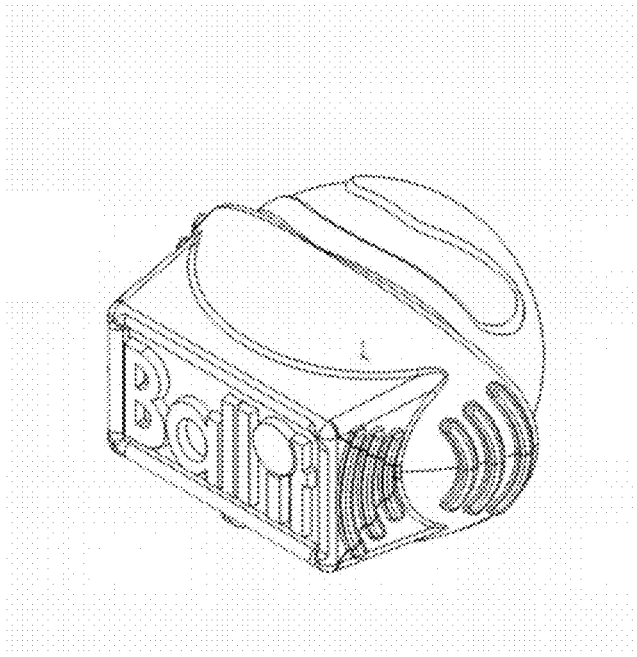
FIG. 9 is a front right perspective view of an exercise ball of the invention.

FIGS. 5-9 show variations of the ball-like devices of the invention, including devices with an additional grip means 22 and/or with ridges 23 to facilitate holding or grasping of the device by the user. The grip means 22 and the ridges 23 are both optional features of the devices of the invention and can be in a variety of shapes and sizes appropriate to the overall size of the device. These devices also have an additional nib 24 that can be located anywhere on the ellipsoid element 20. In FIG. 6, the nib is located on the center front of the ellipsoid element 20 at the bottom of the grip means 22. The nib has a hole to allow attachment of string or cord. While the nib is an optional feature, it adds another safety feature to the device. The string or cord can optionally have a wrist band attached. Wrist bands are known in the art.

The devices of the invention are made from biocompatible, non-toxic materials capable of providing the desired resistance. These materials include food-grade rubber, natural rubber, silicone rubber, silicone and latex as well as any FDA-approved rubber, latex or suitable polymer. In some embodiments, the devices can be made from food-grade materials or coated with food-grade materials.

The "resistance" as used herein is the force per unit area required to deform the device so that the top and bottom walls of the device just touch each other (the collapse point). The resistance can be measured, for example, by placing the device on a scale, pressing down on the device with a plate having a one inch square surface area and determining the weight on the scale at which the top and bottom walls of the device just touch each other. If the scale is calibrated in pounds, then the resistance associated with the device is expressed as pounds per square inch (psi). When resistance is measured in this manner, devices of the present invention have a resistance (i.e., the resistance at the collapse point) that is between about 40 psi and about 150 psi. Preferred resistances are between about 60 and about 120 psi, and preferably are about 50, 60, 70, 80, 90, 100, 110 or 120 psi, and most preferably are about 60, about 90 or about 120 psi.

The resistance of a device depends on the size of the device, the material from which the device is made, and the thickness of the walls of the device. One of skill in the art can readily vary these parameters to produce the devices of the invention.

The ball-like devices of the invention are conveniently provided as a kit with from 2-6 devices and includes kits with 2, 3, 4, 5 or 6 devices. Optionally, the kits can be compartmentalized, having a shape appropriate to receive and hold a device of the invention. The individual devices can have the same or different resistances. Kits with devices of different resistance are preferred, particularly a kit with three devices wherein the resistances are 60, 90- and 120 psi, respectively. The kits of the invention optionally contain instructions for exercising with the devices as well as instructions for following a healthy diet plan, including diet plans aimed at promoting weight loss. Many such diet plans are known in the art. In some embodiments of the kits, the devices are color-coded to indicate the different resistance levels of each ball-like device in the kit and to simplify identifying balls of different resistance levels.

Figure 10:
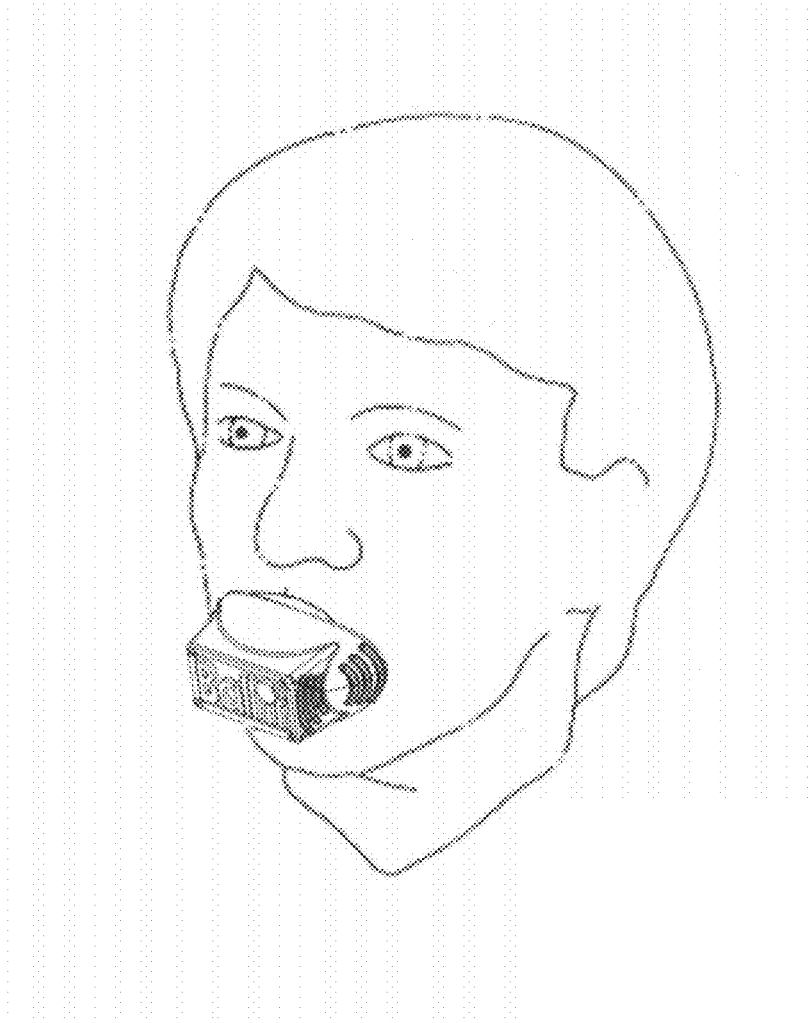
FIG. 10 illustrates placement of an exercise ball in the mouth during use.
Figure 11:
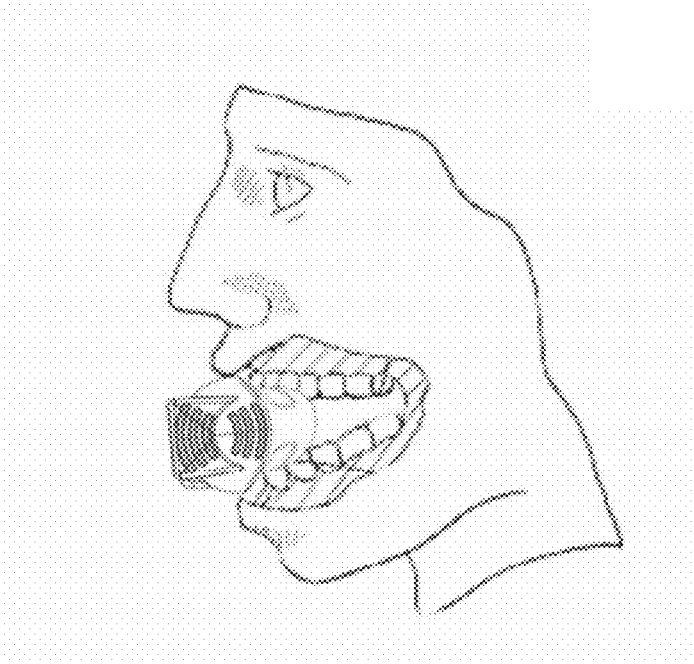
FIG. 11 depicts a cut-away, side view of an exercise the ball in the mouth of a user, showing relative placement of the teeth.

To use the device, it is placed in the mouth as shown in FIGS. 10 and 11. Exercises should be performed consistently and regularly. Exercise of the facial and/or jaw muscles with the device typically, but not necessarily begins, with the device of lowest resistance, e.g., devices having a resistance of 40-70 psi, and then progresses to devices with higher and higher resistance, e.g., devices with a resistance of 80-100 psi, followed by devices with a resistance of 110-140 psi. The progression to higher resistance depends on the user's ability, comfort and preferences. However, progressing so that the facial muscles are worked until fatigue may provide optimal results when the devices are used regularly as described herein.

In use, a device of the invention is clenched or grasped between the upper and lower teeth of the user along the guide indentations and from 1-4 sets of exercises are performed, with each set including from about 5 to about 30 repetitions of a particular movement. Movements include chewing and gnawing motions as well as motions simulating opening and closing of the mouth while grasping the device between the teeth. The exercise regimen can include any combinations of jaw, mouth and cheek movements. For example, a user can perform gnawing motions with 3 sets of 15-20 repetitions twice a day, five days a week for three consecutive weeks to obtain satisfactory results and then change to a device of higher resistance and repeat the program. Exercise is progressed by increasing resistance of the device or by adding sets or repetitions. Exercises can be repeated. It is helpful but not essential to stretch the facial and/or jaw muscles before and after exercise.

When the user exercises regularly and consistently with a device of the invention, the facial and/or jaw muscles of the user are toned and strengthened, often resulting in an enhanced facial appearance. The user may also experience a period of weight loss. The device is preferably used once or twice a day, for three to five days per week. Increasing the resistance provides more intense exercise and can lead to further strengthening and a more impressive facial appearance.

In accordance with the foregoing use of the devices of the invention, another aspect of the invention is directed to a method of toning and strengthening facial muscles by having a user position a device of the invention in his/her mouth, gripping the device between the upper and lower teeth and performing a series of chewing, gnawing, mouth-opening or mouth-closing motions, or any combination thereof, while maintaining the device between upper and lower teeth. The movements are repeated for a time and in a number to tone and/or strengthen the user's facial muscles. In a preferred embodiment, the user performs the series of motions from 1 to 4 times at least three days per week, with each set including from about 5 to about 30 repetitions of any one of, or combination of, jaw and/or cheek movements. Toning of facial muscles can be assessed by a slimmer appearance of the user's face and by the presence of firmer skin or increase in firmness of the skin. Strengthening of facial muscles can be determined by methods known in the art, e.g., by having a trained physiologist or physical therapist assess muscle strength or by using a device for measuring muscle strength.

In yet another aspect of the invention, the ball-like device of the invention is used in a method of weight loss which comprises regularly exercising facial muscles with a ball-like exercise device of the invention as described above. With regular use, the user's weight decreases. The weight loss can be enhanced and/or aided by following a healthy diet plan.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention. All references patents, patent applications or other documents cited are herein incorporated by reference in their entirety.

EXAMPLE 1

Detailed Weight Loss

A male subject followed an exercise program with an exercise device of the invention over a period of about 4 years. The subject generally performed 2-3 sets of 20-30 repetitions on 3-5 days each week, starting with an exercise ball with 60 psi resistance and progressing to one with 90 psi after three weeks, and 120 psi after another three weeks. Before beginning the program, the subject weighed 206 lbs. After one, two and three months of regular use, the subject weighed 193, 183 and 172 pounds, respectively, for a total weight loss of 34 pounds. In the first month, the subject experienced tightness in the facial muscles around the mouth and neck and noticed a drop in appetite, a drop in stress level as well as experienced more mental clarity. During this time the subject's facial appearance was drawn up, not down and had a fuller look.

The subject reduced regular use of the exercise device and within three months gained back 12 pounds but thereafter maintained a steady weight for 6 months. The subject completely stopped use of the exercise device for two months and gained 19 pounds. Nevertheless, the subject's improved facial appearance was maintained. The subject then returned to regular use of the exercise device, and over the next three months, lost 11, 8 and 2 pounds, respectively, had further improvement in facial appearance (sharper and more striking appearance), and felt more energetic and confident.

After the second period of significant weight loss, with the exception of one month, the subject continued regular use of the exercise device for at least 19 months and maintained a weight of approximately 185 pounds, with a 2-3 pound fluctuation. During the one month exception, the subject stopped regular use of the exercise device and gained six pounds but lost those pounds upon resuming regular use of the exercise ball the following month. Over all, the subject's facial appearance improved, providing a broader look around the jaw line and a more masculine appearance. The subject reported that use of the exercise device gave him more mental clarity and helped to relieve stress after each use.

EXAMPLE 2

Weight Loss Study

Four subjects (two males, two females) used an exercise device of the invention for a period of approximately 4 years, following a general program of gnawing or chewing on the device for 2-3 sets of 20-30 repetitions from 3-5 times per week as described in Example 1. For the first six months of use, the subjects experienced continual weight loss. During that time, subject one went from 206 to 179 pounds (27 pound loss); subject two went from 165 to 120 pounds (45 pound loss); subject 3 went from 245 pounds to 186 pounds (79 pound loss) and Subject 4 went from 245 to 176 pounds (69 pound loss). After one year the same subjects weighed, 193, 111, 191 and 154 pounds respectively. At the end of four years, total weight loss was 18, 54, 80 and 99 pounds, respectively. While the subjects generally used the exercise device as suggested for four years, each experienced occasional reductions in usage, often accompanied by slight increases in weight, which were lost upon resumption of regular usage.

During the course of usage, several subjects reported sore facial muscles but that the soreness diminished with regular usage. All reported improved facial appearance and many reported a reduction in stress and appetite. One subject who had smoked two packs of cigarettes per day was able to reduce that amount and, after about three months, quit smoking completely and continued to refrain from smoking through the end of the study.

I claim:

1. A ball-like exercise device adapted to fit in a user's mouth comprising a spherical element conjoined to an ellipsoid safety element that extends sideways around the spherical element, wherein the top and bottom of said spherical element have symmetrically opposed indentations shaped to guide placement of a user's upper and lower teeth and wherein said device is comprised of a biocompatible, resilient material.

2. The ball-like exercise device of claim 1, wherein said device has a resistance between about 40 and about 150 psi.

3. The ball-like exercise device of claim 2 wherein said device has a resistance between about 60 and about 120 psi.

4. The ball-like exercise device of claim 3, wherein said device has a resistance of about 60, about 90 or about 120 psi.

5. The ball-like exercise device of claim 1, wherein said device has a coating of food-grade rubber or food-grade silicon.

6. The ball-like exercise device of claim 1, wherein said ellipsoid safety element further comprises a grip.

7. The ball-like exercise device of claim 1, wherein said ellipsoid safety element further comprises a nib for attaching a string or an elastic cord.

8. An exercise kit comprising from two to six ball-like exercise devices of any one of claims 1.

9. The kit of claim 8, wherein each device has the same resistance or different resistance.

10. The kit of claim 9, wherein said exercise devices are color-coded.

11. The kit of claim 10 comprising three exercise devices, with a first device having a resistance of about 60 psi, a second exercise device having a resistance of about 90 psi and a third device having a resistance of about 120 psi.

12. The kit of claim 8, further comprising a set of instructions for use of said device to exercise facial muscles.

13. The kit of claim 12, further comprising a set of instructions for following a weight loss plan or a healthy diet plan.

14. A method of toning and/or strengthening facial muscles which comprises positioning the ball-like device of claim 1 in the mouth of a user, gripping the device between the user's upper and lower teeth and performing a series of chewing, gnawing, mouth opening or mouth closing motions while maintaining the ball-like exercise device between the user's upper and lower teeth for a time and in a number to tone and/or strengthen facial muscles of said user.

15. The method of claim 14, wherein said series is from 1 to 4 daily sets of from about 5 to about 30 of any one of, or any combination of, said motions.

16. The method of claim 15 wherein the user performs said motions with devices having successively increased psi.

17. A method of weight loss which comprises regularly exercising facial muscles with the ball-like exercise device of claim 1 for a time and in an amount that leads to weight loss of said user.

* * * * *